US009617677B2

(12) United States Patent
Buso et al.

(10) Patent No.: US 9,617,677 B2
(45) Date of Patent: Apr. 11, 2017

(54) LAUNDRY MACHINE

(71) Applicant: Electrolux Appliances Aktiebolag, Stockholm (SE)

(72) Inventors: Danny Buso, San Quirino (IT); Stefano De Paoli, Fiume Veneto (IT); Iyer Swaminathan, Singapore (SG)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/650,134

(22) PCT Filed: Dec. 6, 2013

(86) PCT No.: PCT/EP2013/075832
§ 371 (c)(1),
(2) Date: Jun. 5, 2015

(87) PCT Pub. No.: WO2014/086986
PCT Pub. Date: Jun. 12, 2014

(65) Prior Publication Data

US 2015/0315740 A1 Nov. 5, 2015

(30) Foreign Application Priority Data

Dec. 6, 2012 (EP) ..... 12195914

(51) Int. Cl.
*A47B 88/00* (2006.01)
*D06F 39/14* (2006.01)

(52) U.S. Cl.
CPC ..... *D06F 39/14* (2013.01)

(58) Field of Classification Search
CPC ..... D06F 39/14; E05D 11/0054; E05D 2011/0072; E05D 2011/0063
(Continued)

(56) References Cited

U.S. PATENT DOCUMENTS 4,787,121 A * 11/1988 Racenis ..... D06F 39/14 16/356
4,847,948 A * 7/1989 Gross ..... E05D 7/0407 16/251
(Continued)

FOREIGN PATENT DOCUMENTS

AU 2006201708 B2 3/2010
EP 2402499 A1 1/2012
(Continued)

OTHER PUBLICATIONS

International Search Report mailed May 2, 2014 in corresponding International Application No. PCT/EP2013/075832.

*Primary Examiner* — Hanh V Tran
(74) *Attorney, Agent, or Firm* — Banner & Witcoff, Ltd.

(57) ABSTRACT

A laundry machine may include a casing (2) with a panel (3) having a laundry loading/unloading opening (4), a door (5) hinged to the casing (2) for opening/closing the laundry loading/unloading opening (4), a hinge (6) adapted to pivotably support the door (5) to the casing (2), and one or more apertures (7) in the door frame (8) on the hinge side allowing the rotation of the door (5) with respect to the hinge (6) when opening/closing. The laundry machine (1) may further include at least one closure element (9) for at least partially closing the one or more apertures (7) when the door (5) is in a closed position in which it closes the loading/unloading opening (4).

5 Claims, 9 Drawing Sheets

(58) Field of Classification Search
USPC ..... 312/329; 16/250, 251
See application file for complete search history.

(56) References Cited

U.S. PATENT DOCUMENTS

| | | | | |
|---|---|---|---|---|
| 4,914,781 | A * | 4/1990 | Sokn | D06F 39/14 16/225 |
| 5,483,771 | A * | 1/1996 | Herbst | E05D 5/04 49/381 |
| 5,592,787 | A * | 1/1997 | Ophardt | E04H 1/1266 52/239 |
| 6,070,294 | A * | 6/2000 | Perkins | A47K 3/36 16/250 |
| 6,317,925 | B1 * | 11/2001 | Pietryga | E05D 3/127 16/250 |
| 7,055,214 | B1 | 6/2006 | Finkelstein | |
| 7,213,374 | B2 * | 5/2007 | Harris | E05D 7/009 16/234 |
| 8,627,610 | B1 * | 1/2014 | Crowther | E05D 7/009 16/250 |
| 2004/0113016 | A1 * | 6/2004 | Eveker | B64C 1/14 244/129.5 |
| 2007/0130730 | A1 * | 6/2007 | Cho | D06F 39/14 16/387 |
| 2007/0257151 | A1 * | 11/2007 | Mindermann | B64C 1/14 244/130 |
| 2009/0212677 | A1 * | 8/2009 | Kocak | D06F 39/14 312/326 |
| 2010/0295428 | A1 * | 11/2010 | Favaro | D06F 39/14 312/228 |
| 2011/0023559 | A1 * | 2/2011 | Schone | D06F 37/10 68/212 |
| 2011/0025178 | A1 * | 2/2011 | Schone | D06F 39/14 312/228 |
| 2012/0020728 | A1 * | 1/2012 | Royer | E02D 29/14 404/25 |
| 2012/0073207 | A1 * | 3/2012 | Shearer | E05D 1/04 49/386 |
| 2014/0026361 | A1 * | 1/2014 | Kim | E05D 11/0054 16/251 |

FOREIGN PATENT DOCUMENTS

| | | | |
|---|---|---|---|
| GB | 941134 | A | 11/1963 |
| JP | 2012223344 | A | 11/2012 |
| TW | 201111584 | A | 4/2011 |
| WO | 2006009363 | A1 | 1/2006 |
| WO | 2012114752 | A1 | 8/2012 |

* cited by examiner

LAUNDRY MACHINE

Aspects of the present invention relate to laundry machines, for example laundry washing machines, laundry dryers and laundry washers/dryers.

BACKGROUND

The use of laundry machines, for example laundry washing machines (i.e. machines which can only wash and rinse laundry), laundry driers (i.e. machines which can only dry laundry), and washing-drying machines (or washer/driers i.e. machines which can wash and also dry laundry), is very widespread and indispensable.

In the present description the term "laundry washing machine" will refer to laundry washing, laundry driers, and laundry washing-drying machines.

Typically, the laundry machines have a housing casing and an access door for inserting the laundry within a rotatable drum contained in the housing casing.

Known laundry machines may be of the front-loading type or of the top-loading type.

A front-loading laundry machine typically comprises a parallelepiped casing or cabinet provided, in one of its lateral walls, with a loading opening for loading and unloading the laundry in/from the rotatable drum contained in the cabinet and having an opening in correspondence of the loading opening formed in the cabinet; a door is hinged to the cabinet for opening/closing the loading opening. The hinge is generally composed of at least a hinge base element and at least one arm connected to the hinge base element.

In conventional laundry machines, the door, typically having a circular shape, has a circular porthole window engaged in a frame element.

The frame element is typically made of plastic, while the porthole window is usually made of a transparent material, so as to allow a user to see the interior of the laundry machine during the operation thereof (for example for checking that the right washing/drying cycle is taking place regularly). Preferably, such transparent material is a heat high endurance material (for example, glass) adapted to withstand the relatively high temperatures to which the laundry machine is subject during its operation. When the door is opened, the laundry to be washed and/or dried can be loaded directly into a rotatable drum and the washed/dried laundry can be removed therefrom.

Possible examples of known doors for laundry machines are provided, for example, in the UK patent No. GB 941134, and in the international patent application No. WO2006/009363.

In the laundry machines known in the art, when the door is to be opened, in order to allow its rotation around the hinge to come to a relative high degree of rotation for facilitating the insertion/removal of the laundry in/from the laundry machine, the door may presents some openings in its external frame, towards the hinge side. Otherwise, in the absence of such openings, the external frame of the door remains at a close contact with the hinge arms, reducing the door opening angle and consequently rendering quite difficult any laundry insertion/removal operation.

Such openings may present a potential risk of injuries for the user. In fact, during the loading/unloading operation of the laundry machines and, in particular, during the opening/closing of the door, a user's fingers may remain entrapped in said openings and crushed between the door and the hinge. Moreover, such openings may represent esthetic defects in the door frame, unpleasant to see by the user.

Thus, it is an object of the present invention to provide a laundry machine wherein the risk for the user to have injuries while loading/unloading the laundry machine due to the presence of said apertures in the door frame is reduced.

SUMMARY OF SELECTED INVENTIVE ASPECTS

Applicant has discovered that by closure elements at least partially covering, when the door is in a closed position, apertures provided in the door frame for allowing its rotation with respect to hinge fixed to the machine casing, the risk that a user will be injured while loading/unloading the laundry machine is reduced, still allowing the rotation of the door frame around the hinge for opening the door itself.

The above objects may be advantageously solved by a laundry machine comprising a casing with a panel having a laundry loading/unloading opening, a door hinged to the casing for opening/closing the laundry loading/unloading opening, a hinge adapted to pivotably support the door to the casing, and one or more apertures in the door frame on the hinge side allowing the rotation of the door with respect to the hinge when opening/closing. The laundry machine may further comprise at least one closure element for at least partially closing (or covering) the one or more apertures when the door is in a closed position in which it closes the loading/unloading opening.

In this way, the apertures in the door frame are at least partially covered by the at least one closure element, reducing the risk of injuries for the user and, at the same time, allowing the door to be still opened with a high degree of rotation.

In fact, by at least partially (preferably totally) covering the apertures when the door is in the closed position, a user is prevented from accidentally inserting his/her fingers inside the apertures in the door frame.

The laundry machine of the present invention may be a laundry washing machine, a laundry dryer or a laundry washer/dryer.

The laundry machine according to the invention may be of the front-loading type or of the top-loading type.

In an advantageous embodiment, the at least one closure element is attached to the hinge.

Preferably, the hinge comprises a hinge base element and one or more arms connected to the hinge base element, the one or more arms being allowed to pass through the one or more apertures of the door during the opening/closing of the door.

More preferably, the at least one closure element is attached to at least one of the one or more arms and/or to the hinge base element).

In an advantageous embodiment, at least one closure element is made in a single piece construction with the hinge.

In a further advantageous embodiment, at least one closure element is welded or shrunk to the hinge.

In another advantageous embodiment, at least one closure element comprises one or more flap or wing elements associated with the door and is at least partially movable with respect to the at least one aperture.

In a preferred embodiment, the one or more flap or wing elements are made of resilient material or comprise at least a resilient portion which allows these one or more flap or wing elements to be flexed.

In this embodiment, being made of resilient material or comprising a resilient portion, a closure element is elastically deformable under particular exertion of forces. That means, on one side, that when the door is in the closed position the closure element is not subjected to forces which deforms it, thus allowing it to at least partially cover the respective aperture in the door frame; on the other side this means that when the door is in the opening phase, the closure element is subjected to a compression which deforms it, thus allowing the passage of the hinge into the respective apertures, and allowing the rotation of the door around the hinge up to a completely open position of the door itself. While the door is getting closed again, the resilient material or a resilient portion allows the closure elements to reassume their original shape and dimensions to allow said closure elements to cover again the respective apertures when the door is in the closed position.

Preferably, hinge comprises one or more engaging regions shaped and positioned in such a way that during the rotation of the door, closure elements engage these one or more engaging regions in such a way to guide the resilient deformation of these closure elements during the rotation of the door.

In a further advantageous embodiment, the flap or wing elements are pivotably associated to the door in such a way to at least partially close the one or more apertures when the door is in the closed position.

Preferably, the door comprises one or more elastic elements associated to one or more flap or wing elements for biasing this one or more flap or wing elements towards a position in which it at least partially closes the one or more apertures.

If the laundry machine is a washing machine or a washer/drier, preferably, a washing tub is accommodated within the cabinet and has an opening in correspondence of the laundry loading/unloading opening.

If the laundry machine is a washing machine or a washer/drier, preferably, a drum is rotatably arranged within the washing tub in such a way that a frontal rim of the drum faces the laundry loading/unloading opening; more preferably a bellows connects a rim of the laundry loading/unloading opening to the opening of the washing tub.

Preferably, each closure element is shaped and dimensioned in such a way to partially cover one of the one or more apertures when the door is in the closed position.

More preferably, the door comprises two apertures, and two closure elements are provided, each one partially covering one of the two apertures.

Advantageously, the above mentioned closure elements may be realized in any suitable material; preferred materials are plastic, metal, wood, or the like. More preferably, the closure elements are made of the same material of the door frame or of the hinge.

BRIEF DESCRIPTION OF THE DRAWINGS

These, and others, features and advantages of the solution according to the present invention will be better understood with reference to the following detailed description of some embodiments thereof, provided merely by way of exemplary and non-limitative purposes, to be read in conjunction with the attached drawings. In particular

DETAILED DESCRIPTION OF EXAMPLE EMBODIMENTS

Figure 1:
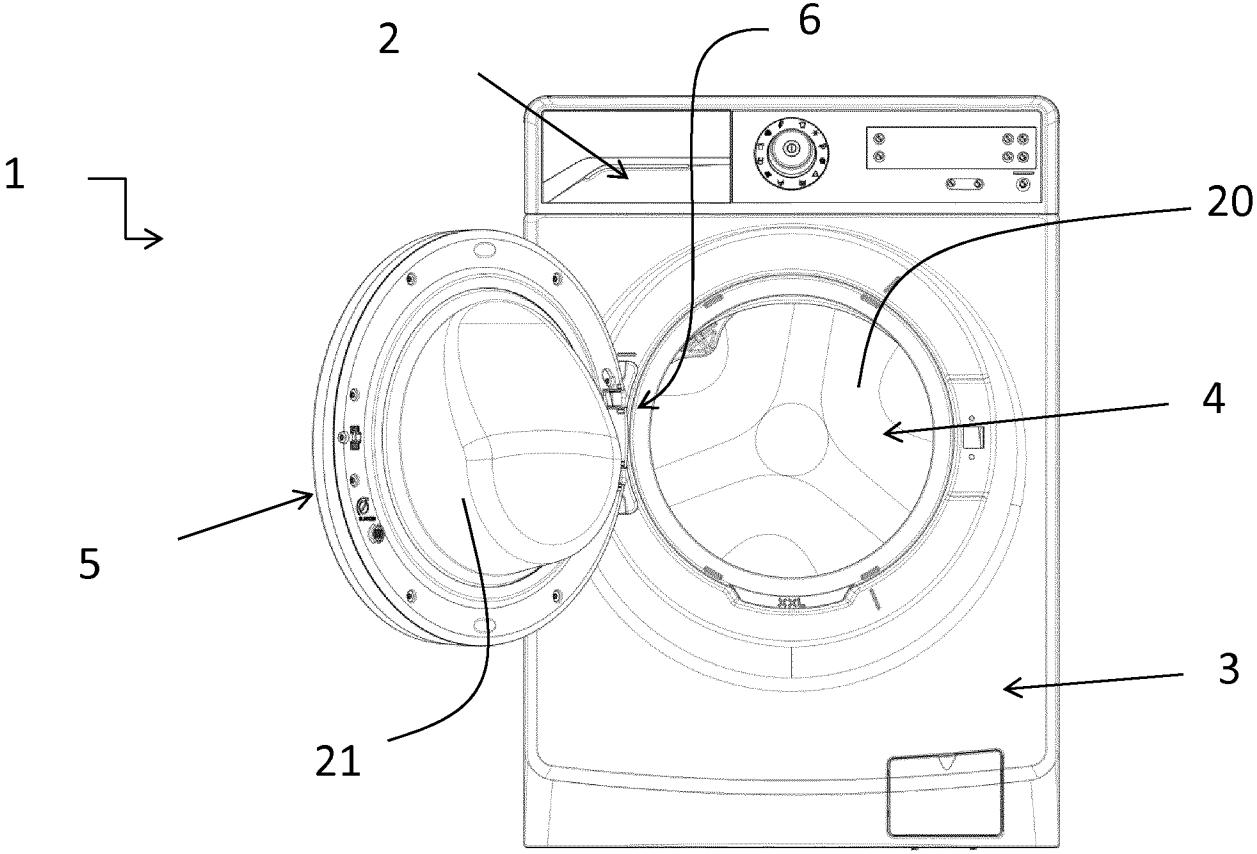
FIG. 1 shows a front-loading type laundry machine according to aspects of the invention.

FIGS. 1-9 show a perspective view of a laundry machine 1, for example a laundry washer, a laundry dryer or a washer/dryer, according to preferred embodiments of the present invention.

The laundry machine 1 comprises a casing or cabinet 2, provided, preferably in a front panel 3, with a laundry loading/unloading opening 4 for loading and unloading the laundry to be washed and/or dried.

A door 5 is preferably provided, hinged to the cabinet 2, for opening/closing the laundry loading/unloading opening 4 during laundry machine operation. The door preferably has a door frame 8 hinged to the casing 2 through a hinge 6 adapted to pivotably support the door 5 to the casing 2.

Door frame preferably comprises a frontal frame 8*a* and a rear frame 8*b*, coupled one another in the assembled condition of the door; between the frontal and rear frame an inspection window or glass 21 is positioned, preferably retained by the frontal and rear frame 8*a*, 8*b*.

The hinge 6 preferably comprises a hinge base element 10 and two arms 11 connected to the hinge base element 10.

The door 5 preferably has a handle 12 positioned on its external portion for facilitating its opening.

A drum 20 is rotatably arranged inside the cabinet 2. In case the laundry machine is a washing machine or a washer/drier, it advantageously comprises also a washing tub (not shown) accommodated within the cabinet 2 and in which the drum 20 is rotatably contained. The washing tub preferably has an opening in correspondence of the laundry loading/unloading opening 4 formed in the cabinet 2.

Figure 2:
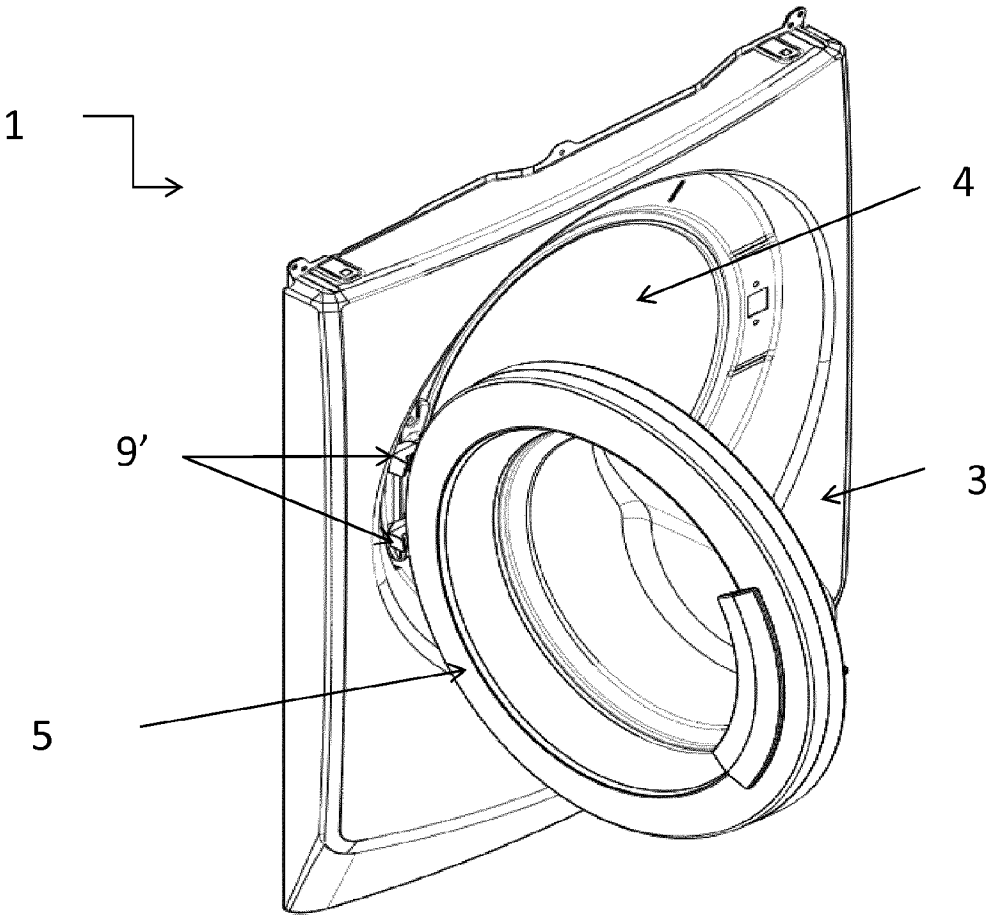
FIG. 2 shows a door of the laundry machine of FIG. 1 in a partially open position.
Figure 5:
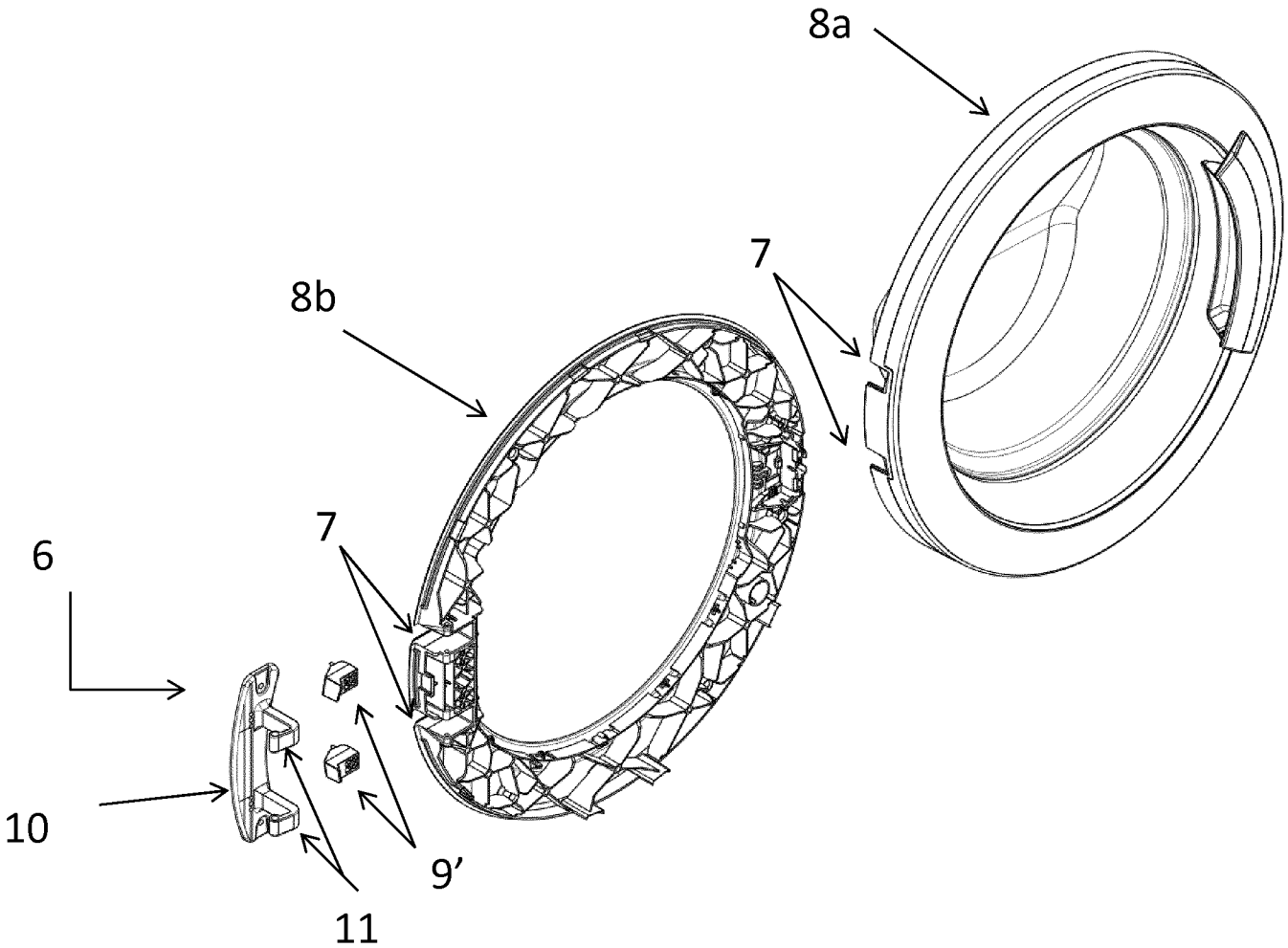
FIG. 5 shows in details the door frame, with closure elements according to a second embodiment of the present invention disassembled from the hinge.
Figure 6:
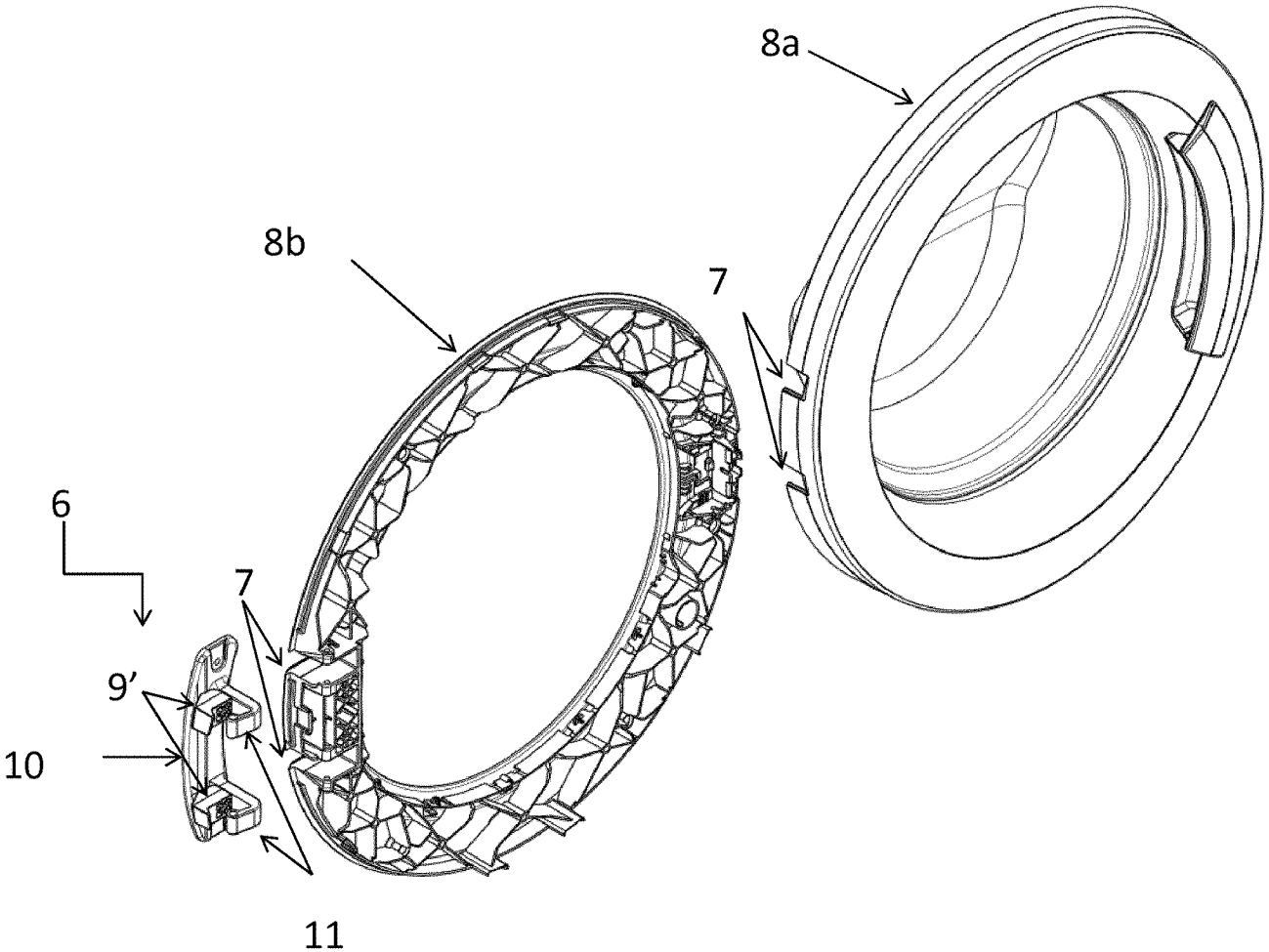
FIG. 6 shows in details the door frame, with closure elements according to the second embodiment of the present invention attached to the hinge.

With particular reference to FIGS. 5 and 6, two apertures 7 are preferably provided in the door frame 8 on the hinge side allowing the rotation of the door 5 with respect to the hinge 6 when opening/closing. Each of the two apertures 7 is preferably of such a shape and dimensions to allow the insertion and passage of each of the respective arms 11 of the hinge 6 during the opening/closing of the door 5. Consequently, the apertures 7, in cooperation with the arms 11, allow the rotation of the door 5 around the hinge 6 to come to a high degree of rotation, for facilitating the insertion/removal of the laundry in/from the laundry loading/unloading opening 4 of the laundry machine 1 (in FIG. 2 is shown the door while in an intermediate position during its opening).

Figure 3:
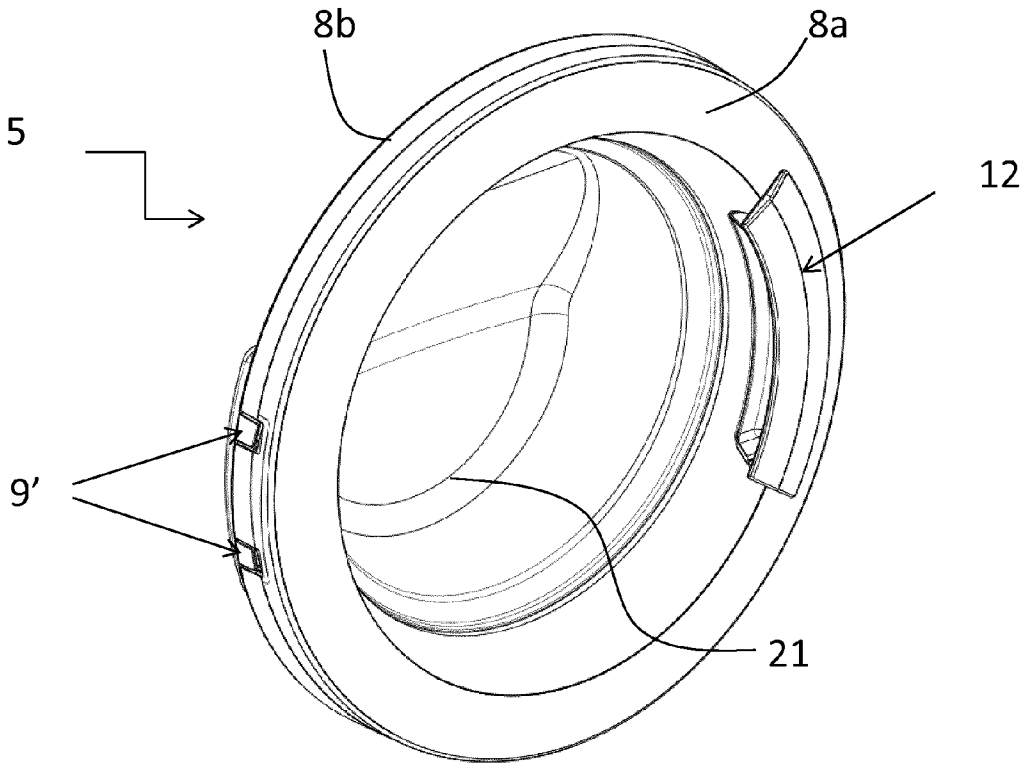
FIG. 3 shows a door in the closed position of the laundry machine with closure elements according to a first embodiment of the present invention.
Figure 4:
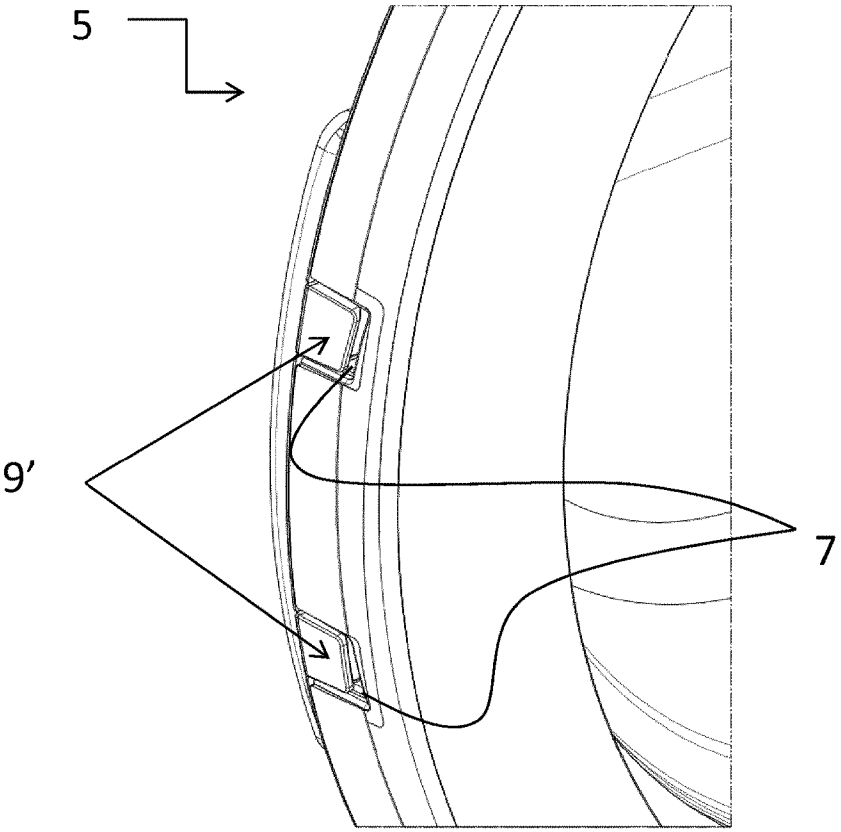
FIG. 4 shows in details the closure elements of the door of FIG. 3.

With particular reference to FIGS. 3 and 4, two closure elements 9' are preferably provided in correspondence of the two apertures 7 in the door frame 8. The two closure elements 9' are preferably of such a shape and dimensions to adapt to the external shape of the door frame 8 and each of the two closure elements 9' respectively close one of the two apertures 7 when the door 5 is in the closed position in which it closes the loading/unloading opening 4.

Thus, by covering the apertures 7 with the closure elements 9', the risk of injuries for the user, as a consequence of the fact that he/she accidentally inserts his/her fingers in the apertures 7 during opening/closing of the door 5 or during laundry loading/unloading operation, is reduced.

In a first embodiment, the two closure elements 9' are attached to the two arms 11 of the hinge 6, one closure element 9' for each arm 11, respectively. In this particular embodiment of the present invention, the arms 11 and the closure elements 9' are preferably made in a single piece construction, preferably made of metal.

With particular reference to FIGS. 5 and 6, a second embodiment of a laundry machine 1 of present invention is shown, wherein each closure element 9' is fixed to the hinge base element 10 and to a respective arm 11, preferably welded or shrunk to them. With reference to FIG. 5, the closure elements 9' are shown disassembled from the hinge base element 10 before they are attached one another, while FIG. 6 shows the final configuration in which the closure elements 9 are welded or shrunk to the hinge base element 10 and arm 11.

Figure 7:
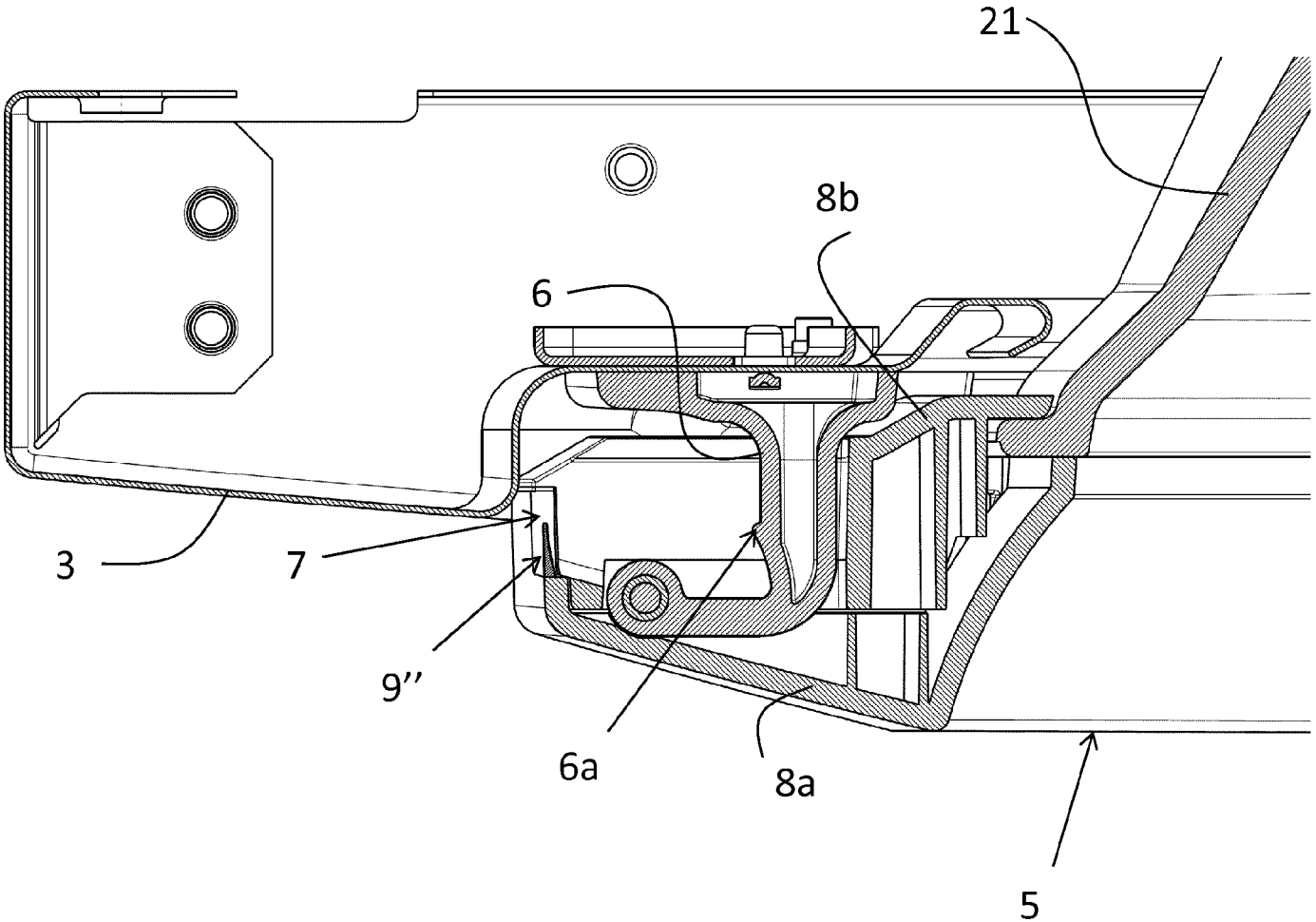
FIG. 7 shows closure elements according to a third embodiment of the present invention while the door is in the closed position.
Figure 8:
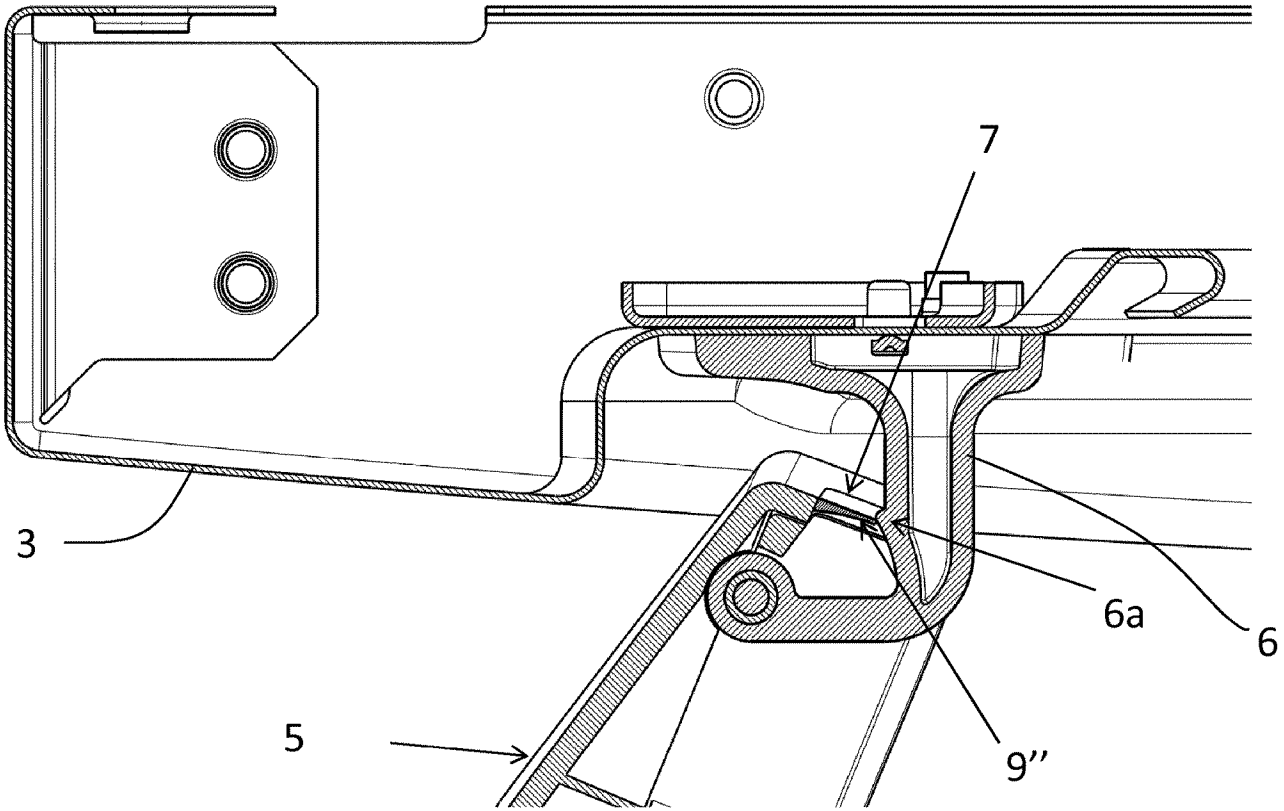
FIG. 8 shows the closure elements of FIG. 7 while the door is in the opening position.
Figure 9:
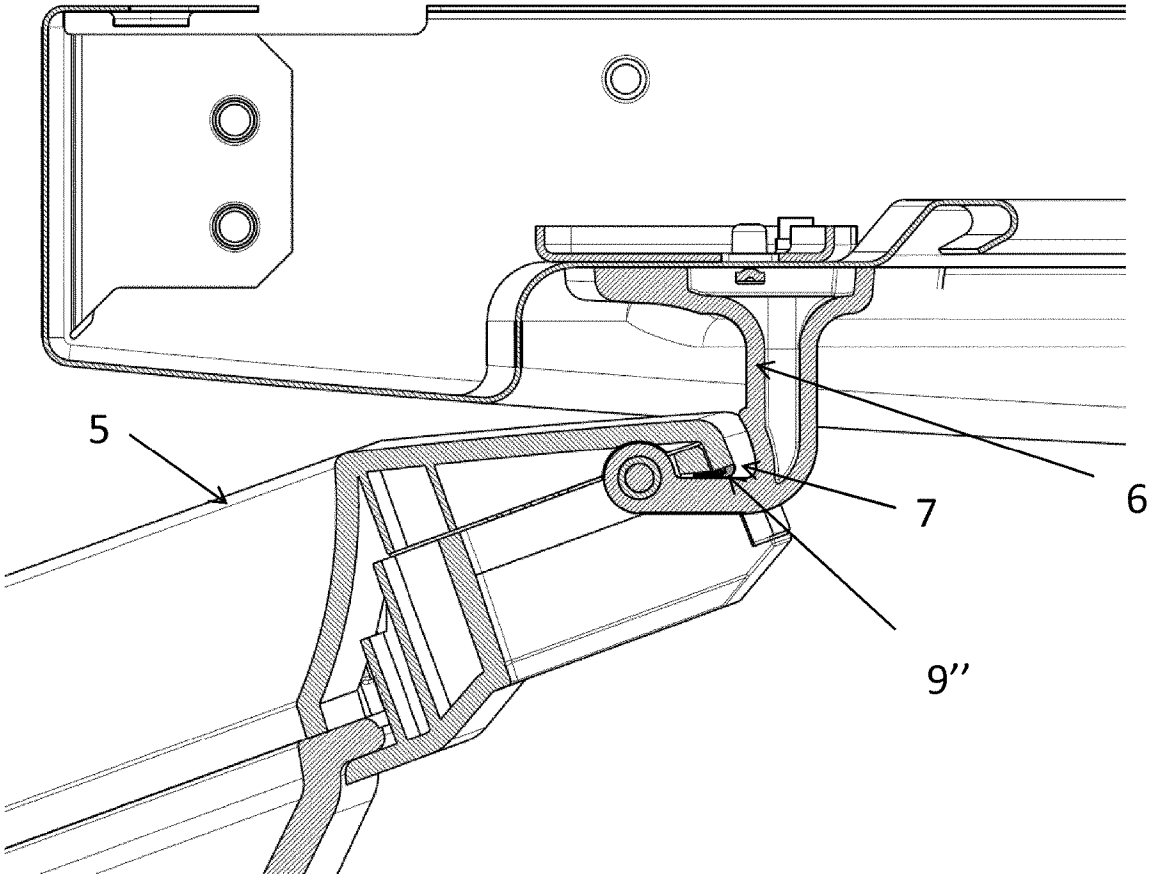
FIG. 9 shows the closure elements of FIG. 7 while the door is in the open position.

With particular reference to FIGS. 7 to 9, a third embodiment of a laundry machine 1 of present invention is shown, wherein the closure elements 9" comprise flaps or wing elements, that are preferably made of a resilient material.

FIGS. 7 to 9 show the laundry machine 1 of the present invention when the door is, respectively, in the closed position, opening position and open position. In particular, in FIG. 7, the door 5 is in the closed position, the closure element 9" completely or almost completely covers the aperture 7 in correspondence of the arms 11 of the hinge 6. Next, in FIG. 8, where the door 5 is shown in its partially opened position (during the opening of the door 5), the closure elements 9" has rotated integrally with the door 5 around the hinge 6, still partially covering the aperture 7.

Preferably hinge 6 comprises one or more engaging regions **6*a* shaped and positioned in such a way that during the rotation of the door 5, closure elements 9" engage these one or more engaging regions 6*a* in such a way to guide the resilient deformation of these closure elements 9" during the rotation of the door 5**.

Finally, in FIG. 9, where the door 5 is shown in its maximum open position, the closure elements 9", being made of resilient material, are elastically deformed against the hinge 6, allowing the passage of the arms 11 into the apertures 7 and thus allowing the complete rotation of the door 5 to facilitate the laundry loading/unloading. When the door is to be closed again to come back at the position shown in FIG. 7, the closure elements 9" reassume the original configuration to cover said apertures 7.

In a fourth embodiment (not shown), the closure elements comprise flap or wing elements that are pivotably associated to the door frame in such a way to at least partially close the one or more apertures 7 when the door is the closed position. In this case, preferably the door 5 comprises one or more elastic elements, for example spring coils, associated to the one or more flap or wing elements for biasing the latter towards a position in which they at least partially close the one or more apertures 7.

While the invention has been described with reference to specific embodiments, various changes may be made and equivalents may be substituted for elements thereof by those skilled in the art without departing from the scope of the invention.

The invention claimed is:

1. A laundry machine comprising:

a casing with a panel having a laundry loading/unloading opening;

a door hinged to the casing, the door configured to open or close the laundry loading/unloading opening;

a hinge adapted to pivotably support the door to the casing;

one or more apertures in a door frame on a hinge side, wherein the one or more apertures are configured to allow a rotation of the door with respect to the hinge when opening or closing the door; and at least one closure element configured to at least partially close the one or more apertures when the door is in a closed position, the closed position closing the loading/unloading opening, wherein the at least one closure element remains stationary during the rotation of the door, wherein the one or more apertures allow passage of at least a portion of the hinge therein during the rotation of the door so as to be at least partially closed by the at least one closure element as the door rotates to the closed position, wherein the hinge comprises a hinge base element and one or more arms connected to the hinge base element, the one or more arms being configured to pass through the one or more apertures when opening or closing the door, and wherein the at least one closure element is attached to the one or more arms.

2. The laundry machine according to claim 1, wherein the at least one closure element comprises a single piece construction with the hinge.

3. The laundry machine according to claim 1, wherein the at least one closure element is welded or shrunk to the hinge.

4. A laundry machine comprising:

a casing with a panel having a laundry loading/unloading opening;

a door hinged to the casing, the door configured to open or close the laundry loading/unloading opening;

a hinge adapted to pivotably support the door to the casing;

one or more apertures in a door frame on a hinge side, wherein the door frame is configured to allow a rotation of the door with respect to the hinge when opening or closing the door; and at least one closure element configured to at least partially close the one or more apertures when the door is in a closed position, the closed position closing the loading/unloading opening, wherein the at least one closure element comprises one or more flap or wing elements associated with the door and wherein the at least one closure element is at least partially movable with respect to the one or more apertures, wherein the one or more flap or wing elements comprise a resilient material or at least a resilient portion, allowing the one or more flap or wing elements to be flexed, and wherein the hinge comprises one or more engaging regions shaped and positioned such that, during the rotation of the door, the closure elements engage the one or more engaging regions and guide a resilient deformation of the closure elements during the rotation of the door.

5. A laundry machine comprising:

a casing with a panel having a laundry loading/unloading opening;

a door hinged to the casing, the door configured to open or close the laundry loading/unloading opening;

a hinge adapted to pivotably support the door to the casing;

one or more apertures in a door frame on a hinge side, wherein the door frame is configured to allow a rotation of the door with respect to the hinge when opening or closing the door; and at least one closure element configured to at least partially close the one or more apertures when the door is in a closed position, the closed position closing the loading/unloading opening, wherein the at least one closure element comprises one or more flap or wing elements associated with the door and wherein the at least one closure element is at least partially movable with respect to the one or more apertures, wherein the flap or wing elements are pivotably associated to the door to at least partially close the one or more apertures when the door is in the closed position, and wherein the door comprises one or more elastic elements associated to the one or more flap or wing elements, the one or more elastic elements being configured to bias the one or more flap or wing elements towards a position in which the one or more flap or wing elements at least partially close the one or more apertures.

* * * * *